US007668485B2

(12) United States Patent
Kitamura

(10) Patent No.: US 7,668,485 B2
(45) Date of Patent: Feb. 23, 2010

(54) IMAGE FORMING APPARATUS

(75) Inventor: Atsuyuki Kitamura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 438 days.

(21) Appl. No.: 11/802,718

(22) Filed: May 24, 2007

(65) Prior Publication Data

US 2008/0159788 A1 Jul. 3, 2008

(30) Foreign Application Priority Data

Dec. 27, 2006 (JP) ..... 2006-351277

(51) Int. Cl.
*G03G 15/01* (2006.01)

(52) U.S. Cl. ..... 399/223; 399/226; 399/227

(58) Field of Classification Search ..... 399/107, 399/110, 113, 116, 119, 120, 222, 223, 226, 399/227

See application file for complete search history.

(56) References Cited

U.S. PATENT DOCUMENTS 4,713,673 A * 12/1987 Kessoku ..... 399/227

5,072,244 A * 12/1991 Aoki et al. ..... 347/116

FOREIGN PATENT DOCUMENTS

JP 2002-341625 11/2002

* cited by examiner

*Primary Examiner*—Hoan H Tran
(74) *Attorney, Agent, or Firm*—Morgan, Lewis & Bockius LLP

(57) ABSTRACT

An image forming apparatus includes an image forming structure including an image carrier that carries an image and an optical writing device that writes a latent image onto the image carrier in an integral arrangement; plural development devices that develop a latent image carried by the image carrier; a shifting mechanism unit that shifts the image forming structure relative to the development devices; and a shift controller that controls the shifting mechanism unit so that the image carrier is shifted to a development position in contact with one of the development devices in a predetermined order.

13 Claims, 13 Drawing Sheets

IMAGE FORMING APPARATUS

CROSS-REFERENCE TO RELATED APPLICATIONS

This application is based on and claims priority under 35 USC 119 from Japanese Patent Application No. 2006-351277 filed Dec. 27, 2006.

BACKGROUND

1. Technical Field

The present invention relates to an image forming apparatus.

2. Related Art

An image forming apparatus configured as below is known. This apparatus includes plural developer carrying members that carry respective color developers and a photoreceptor that is placed so that it can be brought in contact with each of the developer carrying members and carries a visible image developed with the developers supplied from the developer carrying members.

SUMMARY

An image forming apparatus includes an image forming structure including an image carrier that carries an image and an optical writing device that writes a latent image onto the image carrier in an integral arrangement; plural development devices that develop a latent image carried by the image carrier; a shifting mechanism unit that shifts the image forming structure relative to the development devices; and a controller that controls the shifting mechanism unit so that the image carrier is shifted to a development position in contact with one of the development devices in a predetermined order.

BRIEF DESCRIPTION OF THE DRAWINGS

Exemplary embodiments of the present invention will be described in detail based on the following figures, wherein.

DETAILED DESCRIPTION

Then, exemplary embodiments of the present invention will be described, based on the drawings.

Figure 1:
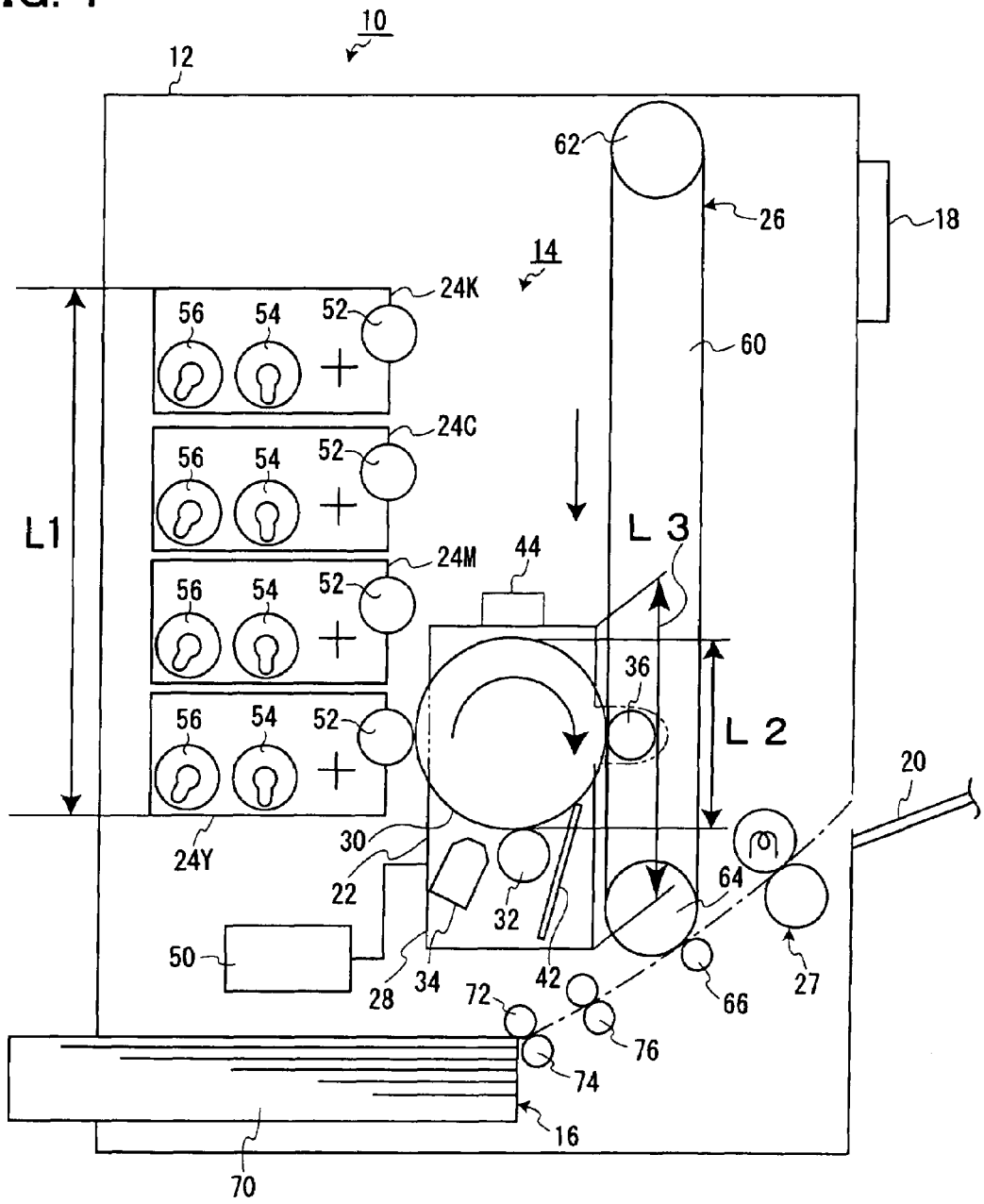
FIG. 1 is a front view showing a configuration of an image forming apparatus relevant to a first exemplary embodiment of the invention.

FIG. 1 shows an image forming apparatus 10 relevant to a first exemplary embodiment of the invention. This image forming apparatus 10 has an image forming apparatus main body 12 and an image forming section 14 and a sheet feeder 16 are disposed inside the apparatus main body 12. On the outside of the apparatus main body 12, an operation panel 18 which is used as an operation unit is provided and an output tray 20 which is used as an output section to which a sheet having an image formed thereon is ejected is mounted, for example, removably from the apparatus main body 12.

The image forming section 14 includes an image forming structure 22, four development devices 24Y, 24M, 24C, 24K, a belt unit 26, and a fixing device 27.

The image forming structure 22 has a housing 28 and the housing 28 contains a photoreceptor 30, a charging device 32, a latent image forming device 34, a transfer device 36, and a cleaning device 42. The photoreceptor 30 is used as an image carrier and has, for example, a substantially cylindrical shape. The charging device 32 is used as a unit that charges the photoreceptor 30 and formed of, for example, a charging roller. The latent image forming device 34 is used as an optical writing device that writes a latent image onto the photoreceptor 30, formed of, for example, a light emitting diode (LED), and creates a latent image on the photoreceptor 30 by, for example, illuminating the photoreceptor 30 with light. The transfer device 36 is used as a transfer unit and transfers a developer image which has been formed by the development of a latent image by the action of the development devices 24 which will be described later onto an intermediate transfer belt 60 which will be described later. The cleaning device 42 is used as a cleaning unit and clears remaining developer particles from the surface of the photoreceptor 30, using, for example, a blade.

The image forming structure 22 is also equipped with a driving device 44. The driving device 44 is used as a driving unit and has a source of driving force such as, for example, a motor (not shown), transfers the driving force from the source to the photoreceptor 30, and drives the photoreceptor 30. As above, the image forming structure 22 includes the photoreceptor 30 and the latent image forming device 34 in an integral arrangement and the driving device 44 is provided in an integral arrangement with the photoreceptor 30 in the image forming structure 22. Moreover, the image forming structure 22 includes the charging device 32 in an integral arrangement with the photoreceptor 30 and the cleaning device 42 also in an integral arrangement with the photoreceptor 30. Here, the integral arrangement means that both components are installed in fixed positions, set at a fixed distance relative to each other.

The image forming structure 22 is connected to an image forming structure shifter 50 which is used as a shifting mechanism unit. The image forming structure shifter 50 is equipped with a source of driving force such as a motor (not shown) and shifts the housing 28 and the photoreceptor 30, charging device 32, latent image forming device 34, transfer device 36, and cleaning device 42 enclosed in the housing 28 as an integral arrangement, that is, they are in fixed positions relative to each other within the housing. This shift motion is, for example, a vertical translation within the apparatus main body 12. The shift motion of the image forming structure 22 by the image forming structure shifter 50 will be detailed later.

The four development devices 24Y, 24M, 24C, 24K each develop a latent image carried by the photoreceptor 30, using a yellow developer, a magenta developer, a cyan developer, and a black developer. The four development devices are arranged substantially in a line in a direction of gravitational force. From the lowest position in the direction of gravitational force, the development device 24Y, development device 24M, development device 24C, and development device 24K are arranged in this order. Each of the development devices 24Y, 24M, 24C, 24K includes a development roller 52 which is used as a developer carrier and augers 54, 56. Using the developer of the corresponding color stirred by the augers 54, 56 and fed to the development roller 52, each development device develops a latent image carried by the photoreceptor 30.

The belt unit 26 includes the intermediate transfer belt 60 which is used as a transfer medium, support rollers 62, 64 which support the intermediate transfer belt 60 in such a way as to allow the belt to run, and a second transfer roller 66 which is used as a transfer unit. One support roller 62 is used as a driving roller and drives the run of the intermediate transfer belt 60 in an arrow direction indicated in FIG. 1. The other support roller 64 is used as a driven roller and rotates driven by the motion of the intermediate transfer belt 60. The intermediate transfer belt 60 is supported by the support rollers 62, 64 so as to pass through a nip between the photoreceptor 30 and the transfer device 36. The second transfer roller 66 further transfers a developer image once transferred to the intermediate transfer belt 60 onto a sheet.

The fixing device 27 is used as a fixing unit and fixes the developer which has been transferred to a sheet from the intermediate transfer belt 60 to the sheet by, for example, applying heat and pressure to the sheet.

The sheet feeder 16 includes a container 70 to contain a stack of sheets which are used as media onto which an image is copied and may be, for example, sheets of plain paper and OHP, a pickup roller 72 which picks up a sheet from the container 70, and a separation roller 74 which feeds a sheet, while separating one sheet from another. The container 70, for example, may be adapted such that it can be pulled out toward the left side in FIG. 1.

The sheet feeder 16 also includes registration rollers 76. The registration rollers 76 stop the forward edge of a sheet picked up by the pickup roller 72 for a moment and start to transport the sheet with its forward edge being stopped for the moment so that the sheet enters a contact nip between the intermediate transfer belt 60 and the second transfer roller 66 at proper timing.

In the image forming apparatus 10, the length of the image forming structure 22 and the length of the photoreceptor 30 in the shift direction of the image forming structure 22 are narrower than the entire length of the plural development devices 24Y, 24M, 24C, 24K. That is, assuming that L2 denotes the length of the photoreceptor 30 in the vertical direction and L1 denotes the entire length of the plural development devices 24Y, 24M, 24C, 24K in the vertical direction, L2 is shorter than L1 (L2<L1). Here, the entire length of the plural development devices 24Y, 24M, 24C, 24K in the vertical direction corresponds to the distance between the top end of the development device 24K installed in the highest position among the four development devices and the bottom end of the development device 24 Y installed in the lowest position. Assuming that L3 denotes the length of the image forming structure 22 in the vertical direction, L3 is shorter than L1 (L3<L1).

Figure 2D:
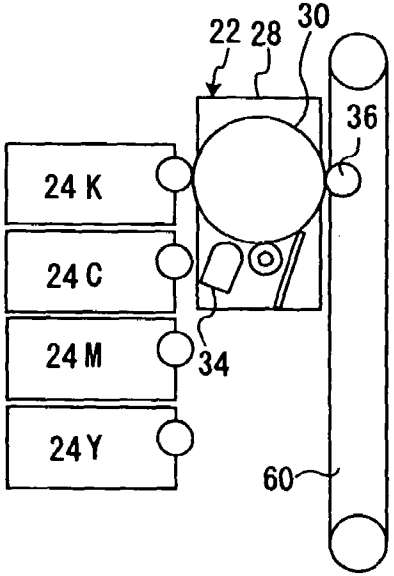
FIGS. 2A to 2D illustrate the changing positions of an image forming structure used in the image forming apparatus relevant to the first exemplary embodiment of the invention.
Figure 2C:
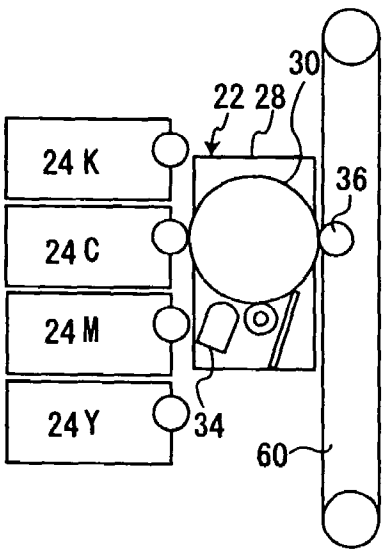
Figure 2B:
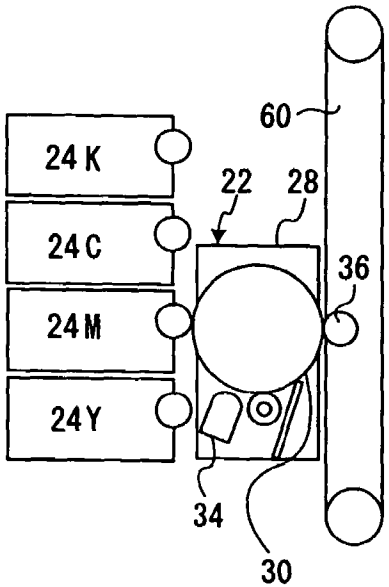
Figure 2A:
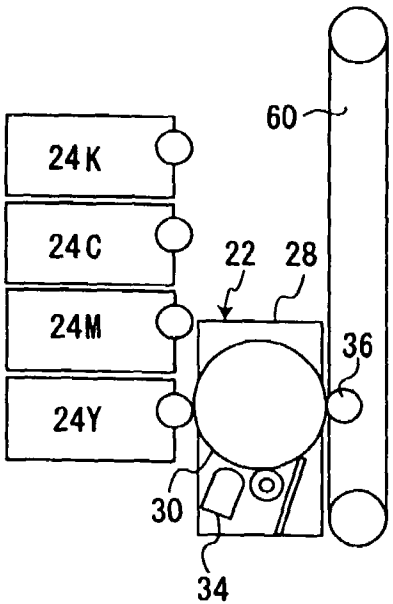

FIGS. 2A to 2D illustrate the changing positions of the image forming structure 22 that is shifted from one position to another by the image forming structure shifter 50. The image forming structure 22 starts to be shifted from a position depicted in FIG. 2A, which is its initial position. Usually, the image forming structure 22 is placed in the position depicted in FIG. 2A upon termination of a series of image forming operations or when the image forming apparatus 10 is powered on. The photoreceptor 30 installed in the image forming structure 22 being in the initial position, that is, the photoreceptor 30 being in the initial position is set in position where a latent image carried by it is developed by the development device 24Y. This position of the photoreceptor 30 and the image forming structure 22 depicted in FIG. 2A is the position in which a latent image is developed by the development device 24Y using a yellow developer; thus, this position is referred to as a yellow development position hereinafter.

From the position depicted in FIG. 2A, when the image forming structure 22 is shifted upward by the image forming structure shifter 50, the photoreceptor 30 installed in the image forming structure 22 is set in position where a latent image carried by it is developed by the development device 24M, as depicted in FIG. 2B. This position of the photoreceptor 30 and the image forming structure 22 depicted in FIG. 2B is the position in which a latent image is developed by the development device 24M using a magenta developer; thus, this position is referred to as a magenta development position hereinafter.

From the position depicted in FIG. 2B, when the image forming structure 22 is shifted upward by the image forming structure shifter 50, the photoreceptor 30 installed in the image forming structure 22 is set in position where a latent image carried by it is developed by the development device 24C, as depicted in FIG. 2C. This position of the photoreceptor 30 and the image forming structure 22 depicted in FIG. 2C is the position in which a latent image is developed by the development device 24C using a cyan developer; thus, this position is referred to as a cyan development position hereinafter.

From the position depicted in FIG. 2C, when the image forming structure 22 is shifted upward by the image forming structure shifter 50, the photoreceptor 30 installed in the image forming structure 22 is set in position where a latent image carried by it is developed by the development device 24K, as depicted in FIG. 2D. This position of the photoreceptor 30 and the image forming structure 22 depicted in FIG. 2C is the position in which a latent image is developed by the development device 24K using a black developer; thus, this position is referred to as a black development position hereinafter.

From one position to another among the positions depicted in FIGS. 2A to 2D, the photoreceptor 30 and the latent image forming device 34 are shifted together as an integral arrangement installed in the housing 28. Thus, even when the photoreceptor 30 is shifted, the distance between the photoreceptor 30 and the latent image forming device 34 remains unchanged. Hence, the image forming apparatus 10 relevant to this exemplary embodiment does not include optics for beam length adjustment for adjusting the beam length from the latent image forming device 34 to the photoreceptor 30 to a given length independent of the shift of the photoreceptor 30. Such optics would be required in some configuration where the distance between the photoreceptor 30 and the latent image forming device 34 changes with a shift of the photoreceptor 30.

From one position to another among the positions depicted in FIGS. 2A to 2D, the photoreceptor 30 and the driving device 44 are shifted together as an integral arrangement. Hence, the image forming apparatus 10 relevant to this exemplary embodiment does not include a driving force transmission mechanism formed of, for example, a gear train for transferring the driving force from the source of deriving force to the photoreceptor 30 set in one of the development positions. Such mechanism would be required in a case where the driving device is separately incorporated in the apparatus main body 12.

Figure 3:
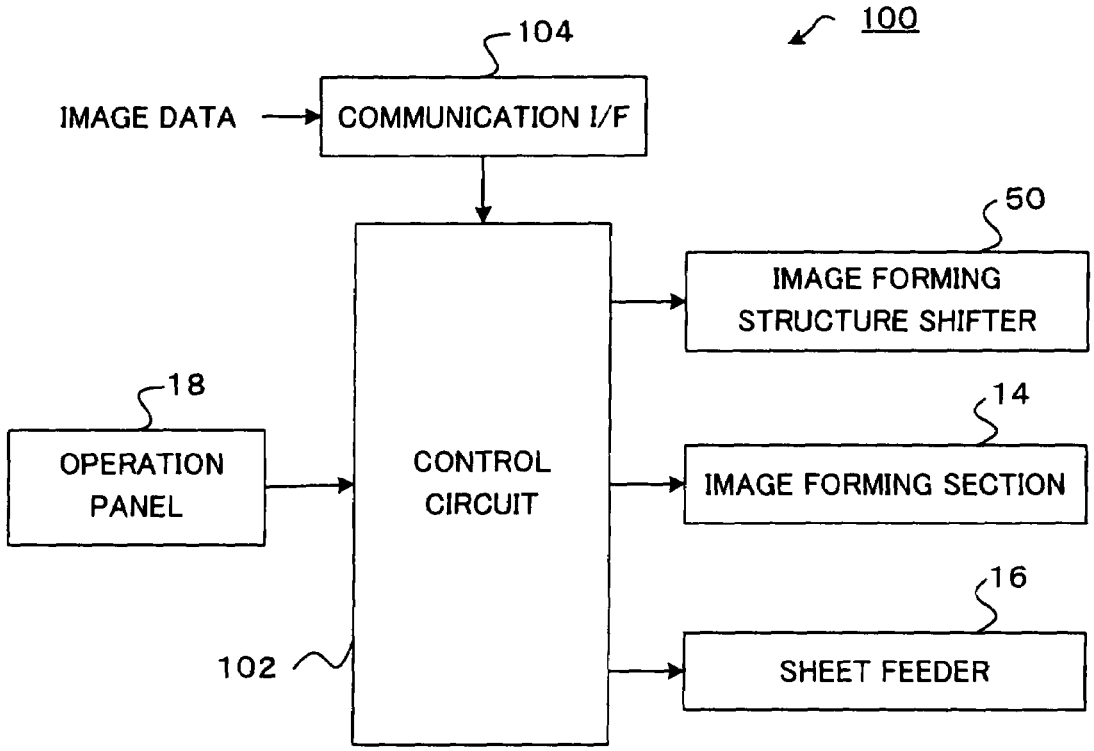
FIG. 3 is a block diagram showing a control device used in the image forming apparatus relevant to the first exemplary embodiment of the invention.

FIG. 3 shows a control device 100 built in the image forming apparatus 10. The control device 100 serves as both a shift controller and a driving device controller. The control device 100 includes a control circuit 102 formed of, for example, a CPU and image data is input to the control circuit 102 via a communication interface 104. An output from the operation panel 18 is also input to the control circuit 102. According to an output from the control circuit 102, the image forming section 14, the sheet feeder 16, and the image forming structure shifter 50 are controlled.

Figure 4:
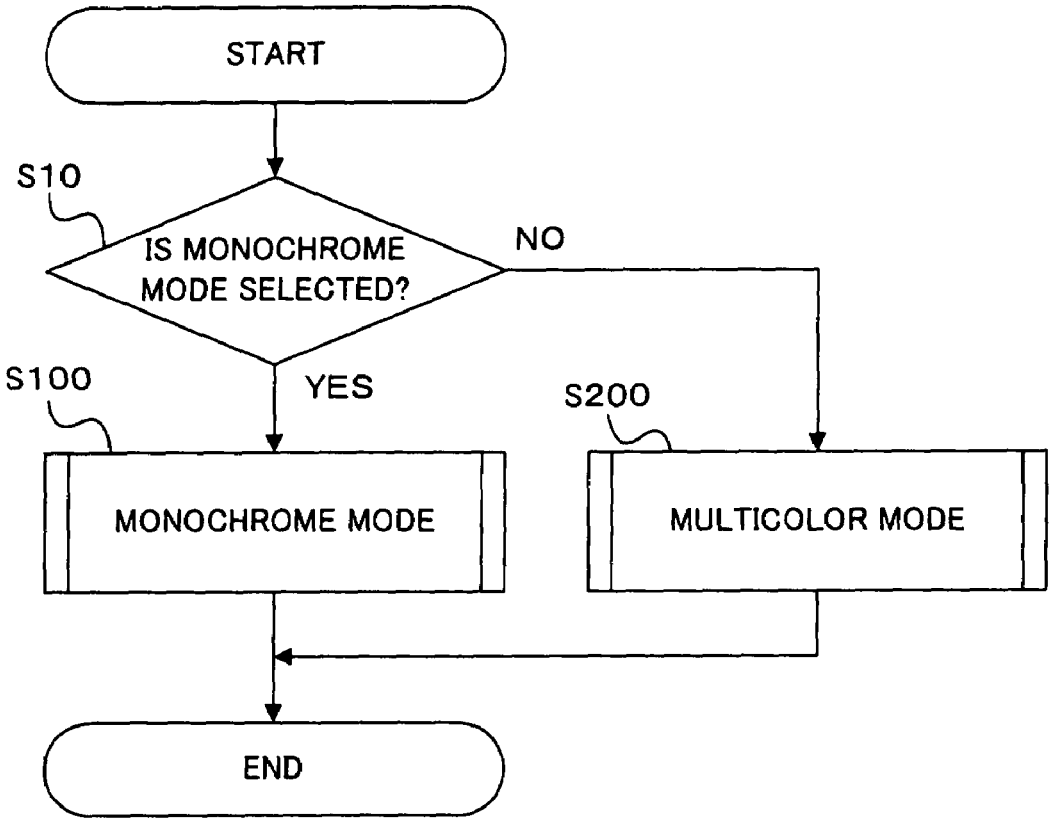
FIG. 4 is a first flowchart illustrating how the image forming apparatus operates, relevant to the first exemplary embodiment of the invention.
Figure 5:
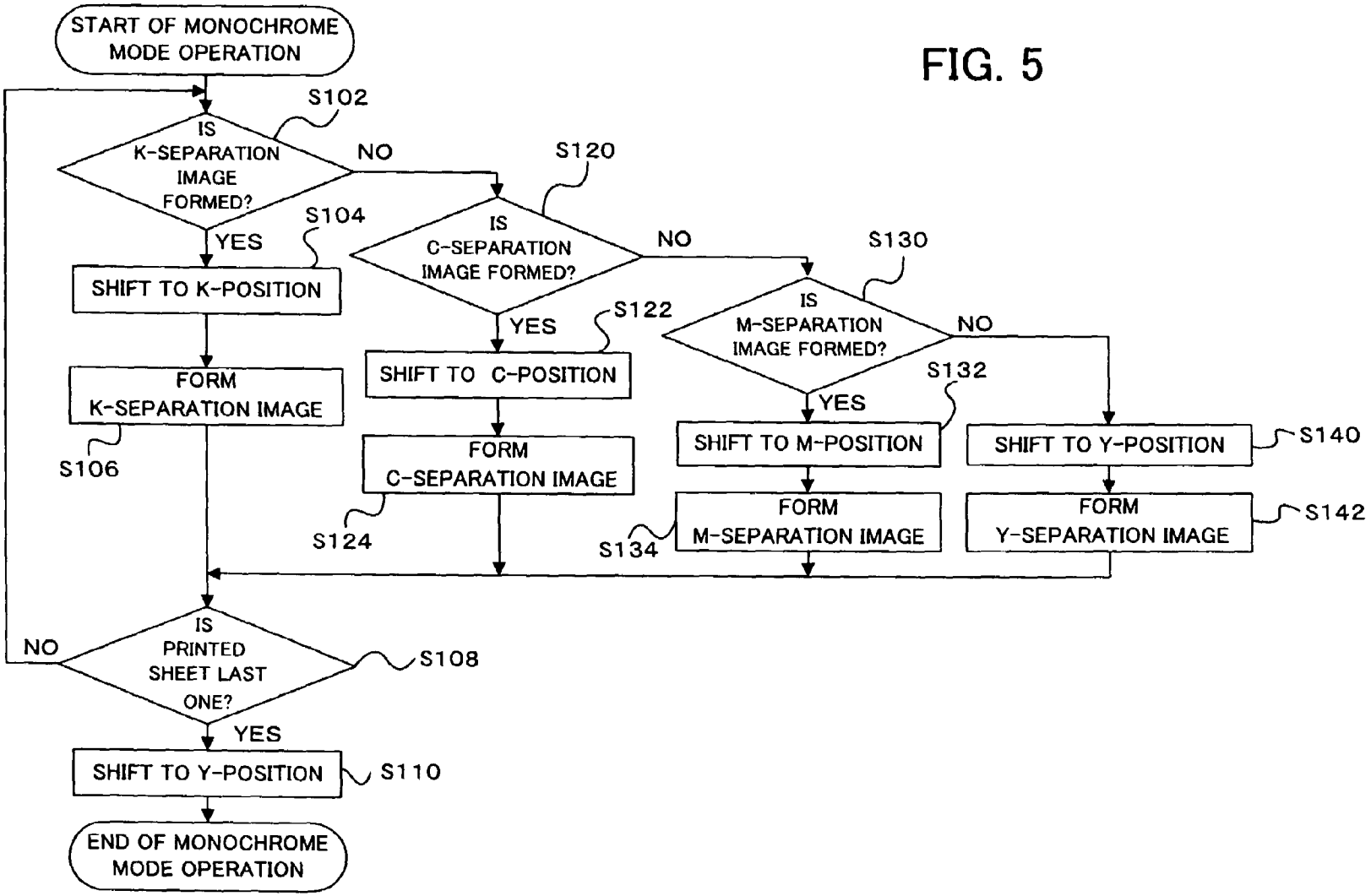
FIG. 5 is a second flowchart illustrating how the image forming apparatus operates, relevant to the first exemplary embodiment of the invention.
Figure 6:
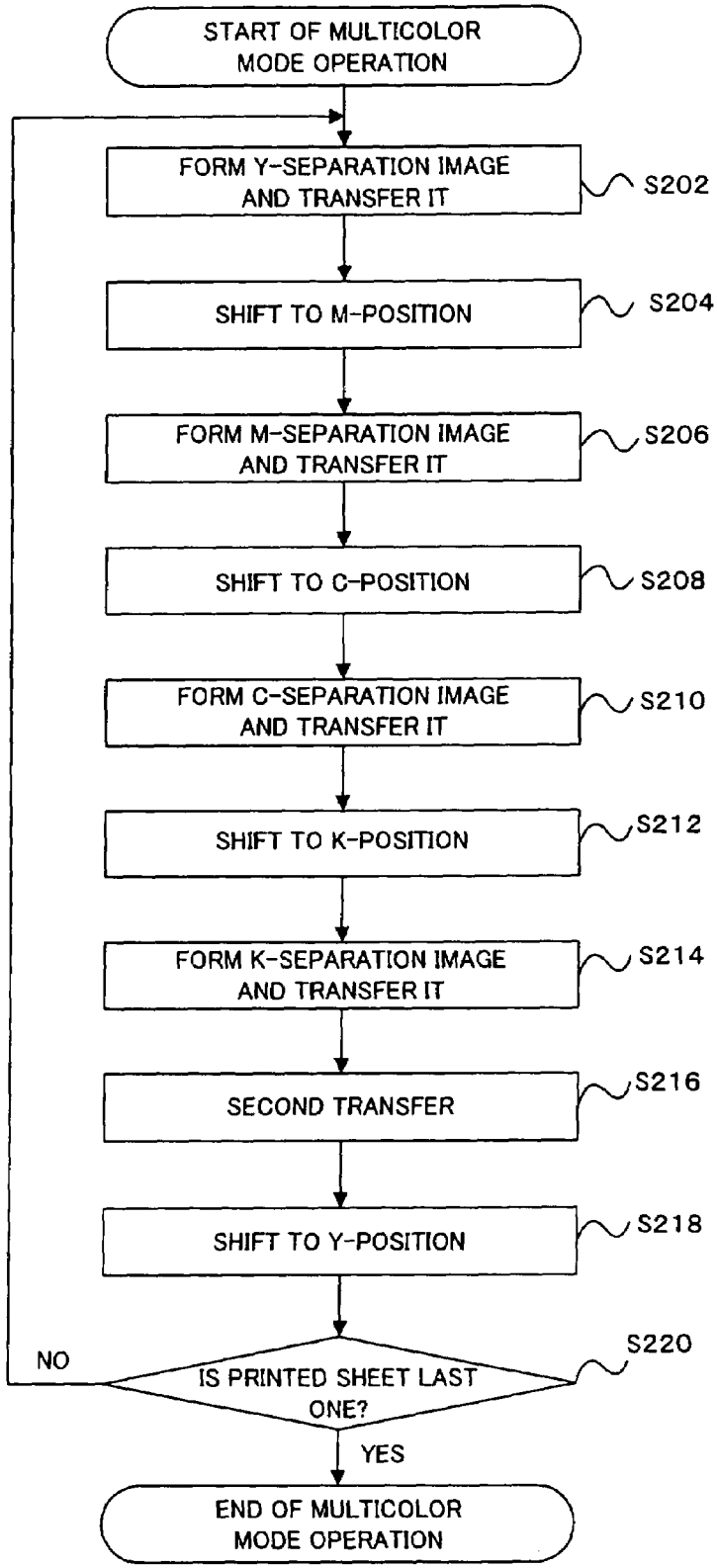
FIG. 6 is a third flowchart illustrating how the image forming apparatus operates, relevant to the first exemplary embodiment of the invention.

FIGS. 4 through 6 show flowcharts of control by the control device 100.

As illustrated in FIG. 4, when an image forming operation starts, the control device 100 determines whether the mode is a monochrome mode at step S10, for example, based on an output from the operation panel 18. Here, the monochrome mode means a mode in which a monochrome image is formed by using any one of the yellow, magenta, cyan, and black developers. If the monochrome mode is selected, as determined at step S10, the procedure goes to a next step S100 where operation in the monochrome mode is executed.

If the monochrome mode is not selected, as determined at step S10, the procedure goes to a next step S200. At step S200, an image is formed in a multicolor mode. Here, the multicolor mode means a mode in which a full-color image is formed by using the yellow, magenta, cyan, and black developers and combining the developer images formed with these developers by overlaying one on top of the other.

FIG. 5 shows a flowchart of control by the control device 100 when an image is formed in the monochrome mode. When a monochrome mode operation starts, the control device 100 determines whether a monochrome image to be formed is a black (K) separation image at step S102. If it is determined that the image to be formed is a black (K) separation image, the procedure goes to a next step S104.

At step S104, the control device 100 controls the image forming structure shifter 50 to shift the photoreceptor 30 to the black development position depicted in FIG. 2D from the initial position, for example, depicted in FIG. 2A. The procedure goes to a next step S106.

At step S106, the control device 100 controls the image forming section 14 to form a black separation image. Specifically, the control device 100 triggers the charging device 32 to charge the surface of the photoreceptor 30, the latent image forming device 34 to project a latent image onto the surface of the photoreceptor 30, the development device 24K using the black developer to develop the latent image on the surface of the photoreceptor 30, and the transfer device 36 to transfer the black developer image formed on the surface of the photoreceptor 30 onto the intermediate transfer belt 60. The black developer image once transferred to the intermediate transfer belt 60 is then transferred onto a sheet by the second transfer roller 66 and fixed to the sheet by the fixing device 27.

At a next step 108, it is determined whether the sheet on which the image has been formed is the last one. If it is determined that the sheet is the last one, the procedure goes to a next step S110. If it is determined that the sheet is not the last one, the procedure returns to step S102.

At step S110, the control device 100 controls the image forming structure shifter 50 to shift the photoreceptor 30 to the yellow development position depicted in FIG. 2A, that is, the initial position. Then, the image forming procedure in monochrome mode terminates.

If the image to be formed is not a black separation image, as determined at the above step S102, the procedure goes to step S120. At step S120, it is determined whether a monochrome image to be formed is a cyan separation image. Then, if it is determined that the image to be formed is a cyan separation image, the procedure goes to a next step S122.

At step S122, the control device 100 controls the image forming structure shifter 50 to shift the photoreceptor 30 to the cyan development position depicted in FIG. 2C from the initial position, for example, depicted in FIG. 2A. The procedure goes to a next step S124.

At step S124, the control device 100 controls the image forming section 14 to form a cyan separation image. At this time, the development device 24C is used for development.

Next, it is determined whether the printed sheet is the last one at step S108, as in the case of forming a black separation image. If it is determined that the sheet is the last one, the control device 100 controls the image forming structure shifter 50 to shift the photoreceptor 30 to the yellow development position depicted in FIG. 2A at step S110. Then, the image forming procedure in monochrome mode terminates.

If the printed sheet is not the last one, as determined at step S108, the procedure returns to step S102, as in the above-described case of forming a black separation image.

If the image to be formed is not a cyan separation image, as determined at the above step S120, the procedure goes to step S130. At step S130, it is determined whether a monochrome image to be formed is a magenta separation image. Then, if it is determined that the image to be formed is a magenta separation image, the procedure goes to a next step S132.

At step S132, the control device 100 controls the image forming structure shifter 50 to shift the photoreceptor 30 to the magenta development position depicted in FIG. 2B from the initial position depicted in FIG. 2A. The procedure goes to a next step S134.

At step S134, the control device 100 controls the image forming section 14 to form a magenta separation image. At this time, the development device 24M is used for development.

Next, it is determined whether the printed sheet is the last one at step S108, as in the case of forming a black separation image or a cyan separation image. If it is determined that the sheet is the last one, the control device 100 controls the image forming structure shifter 50 to shift the photoreceptor 30 to the yellow development position depicted in FIG. 2A at step S110. Then, the image forming procedure in monochrome mode terminates.

If the printed sheet is not the last one, as determined at step S108, the procedure returns to step S102, as in the above-described case of forming a black separation image or a cyan separation image.

If the image to be formed is not a magenta separation image, as determined at the above step S130, a monochrome image to be formed is not any of black, cyan, and magenta separation images and, therefore, the procedure goes to a next step S140 to form a yellow separation image.

At step S140, the control device 100 controls the image forming structure shifter 50 to shift the photoreceptor 30 to the yellow development position depicted in FIG. 2A. The step S140 does not have to be performed when the photoreceptor 30 is initially set in the yellow development position, for example, in such a case that a yellow separation image is formed on the first sheet in the image forming procedure. In step S140, if a yellow separation image is going to be formed, for example, when the photoreceptor 30 is in the cyan development position upon forming a cyan separation image on the preceding sheet, the control device 100 controls the image forming structure shifter 50 to shift the photoreceptor 30 from the cyan development position depicted in FIG. 2C to the yellow development position depicted in FIG. 2A.

At step S142, the control device 100 controls the image forming section 14 to form a yellow separation image. At this time, the development device 24Y is used for development.

At the next step S108, it is determined whether the printed sheet is the last one. If the sheet is not the last one, as determined at this step, the procedure returns to step S102. If the sheet is the last one, as determined at step S108, it is made certain that the image forming structure 22 is set in the yellow development position at step S110. Then, the image forming procedure in monochrome mode terminates.

In the above-described control flow for forming a image in monochrome mode, when shifting the image forming structure 22 in the steps S104, S122, S132, and S140, control may be performed such that the photoreceptor 30 is run by the driving device 44 during the shift motion of the image forming structure 22 by control of the control circuit 102. If the photoreceptor 30 is run during the shift motion of the image forming structure 22, latency before the start of forming an image by the shifted image forming structure 22 becomes shorter than when the transfer of the driving force to the photoreceptor 30 is started after the shift of the image forming structure 22.

FIG. 6 shows a flowchart of control by the control device 100 when an image is formed in multicolor mode. The control of multicolor mode operation is performed, if the monochrome mode is not selected, as determined at the above step S10 (see FIG. 4). When a multicolor mode operation starts, the control device 100 controls the image forming section 14 to form a yellow separation image at step S202. At this time, the development device 24Y is used for development. Since the image forming structure 22 is controlled to shift to the yellow development position which is the initial position, depicted in FIG. 2A, upon the termination of an image forming procedure in both multicolor mode and monochrome mode, no extra operation is needed to shift the image forming structure 22 to the yellow development position prior to step S202.

At step S202, a yellow developer image is formed on the surface of the photoreceptor 30 and this yellow developer image is transferred to the intermediate transfer belt 60.

At a next step 204, the control device 100 controls the image forming structure shifter 50 to shift the photoreceptor 30 to the magenta development position.

At a next step S206, a magenta developer image is formed on the photoreceptor 30 and this magenta developer image is transferred to the intermediate transfer belt 60 in a fashion to be overlaid on top of the yellow developer image. In the operation of step S206, the development device 24M is used for development.

At a next step S208, the control device 100 controls the image forming structure shifter 50 to shift the photoreceptor 30 to the cyan development position.

At a next step S210, a cyan developer image is formed on the photoreceptor 30 and this cyan developer image is transferred to the intermediate transfer belt 60 in a fashion to be overlaid on top of the yellow and magenta developer images. In the operation of step S210, the development device 24C is used for development.

At a next step S212, the control device 100 controls the image forming structure shifter 50 to shift the photoreceptor 30 to the black development position.

At a next step S214, a black developer image is formed on the photoreceptor 30 and this black developer image is transferred to the intermediate transfer belt 60 in a fashion to be overlaid on top of the yellow, magenta, and cyan developer images. In the operation of step S214, the development device 24K is used for development.

At a next step S216, the control device 100 controls the sheet feeder 16 so that a multicolor developer image in which the yellow, magenta, cyan, and black developer images are combined, carried on the intermediate transfer belt 60, is transferred to a sheet by the second transfer roller 66. The multicolor developer image transferred to the sheet is fixed to the sheet by the fixing device 27.

At a next step S218, the control device 100 controls the image forming structure shifter 50 to shift the photoreceptor 30 to the yellow development position (initial position) depicted in FIG. 2A.

At a next step S220, it is determined whether the sheet on which the image has been formed is the last one. If the sheet is the last one, the multicolor mode terminates and the image forming procedure terminates. If the sheet on which the image has been formed is not the last one, as determined at step S220, the procedure returns to step S202.

In the above-described control flow for forming a image in multicolor mode, when shifting the image forming structure 22 in the steps S204, S208, S212, and S218, control may be performed such that the photoreceptor 30 is run by the driving device 44 during the shift motion of the image forming structure 22 by control of the control circuit 102. If the photoreceptor 30 is run during the shift motion of the image forming structure 22, latency before the start of forming an image by the shifted image forming structure 22 becomes shorter than when the transfer of the driving force to the photoreceptor 30 is started after the shift of the image forming structure 22.

Figure 7:
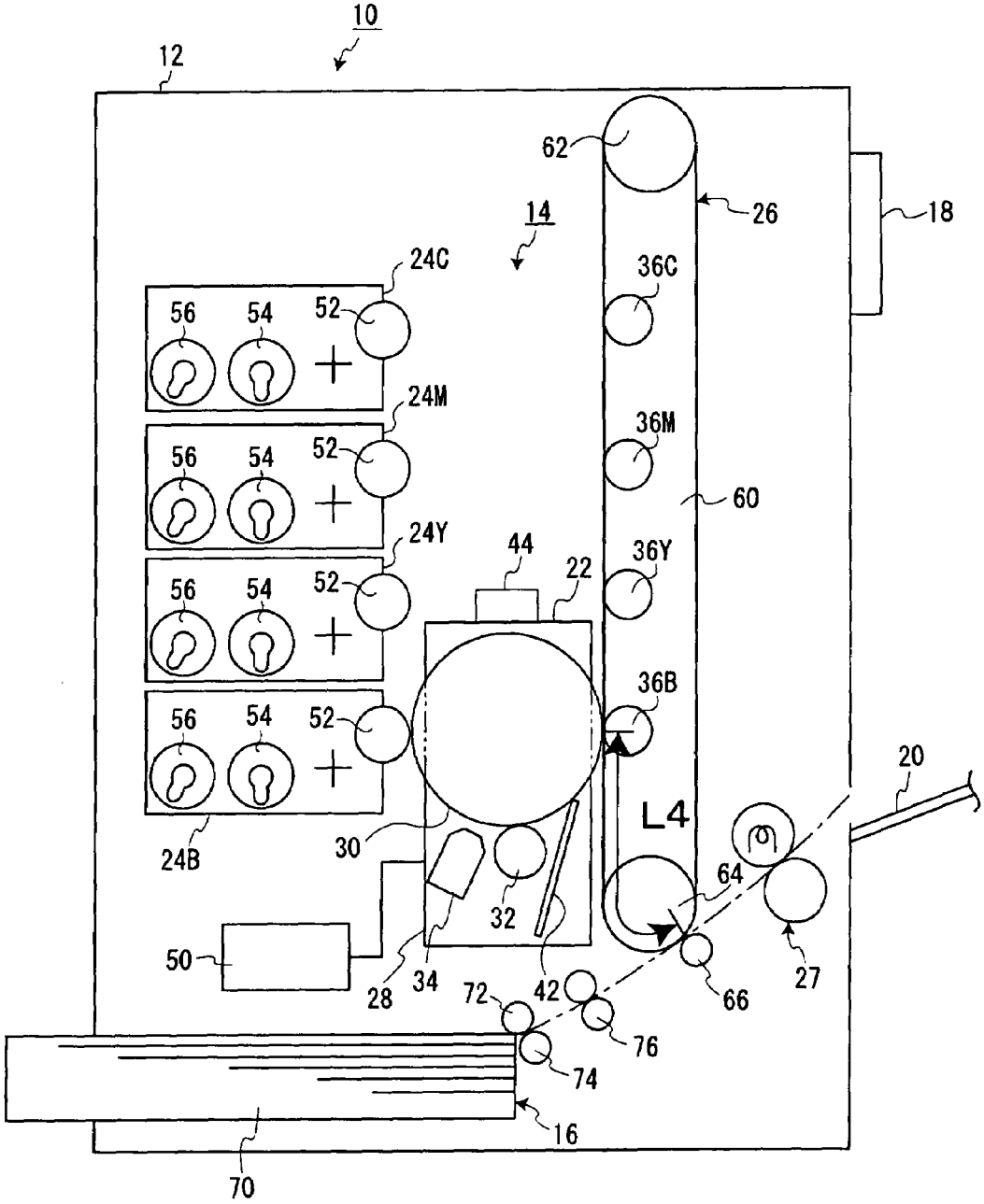
FIG. 7 is a front view showing a configuration of an image forming apparatus relevant to a second exemplary embodiment of the invention.

FIG. 7 shows an image forming apparatus 10 relevant to a second exemplary embodiment of the invention.

In the above-described first exemplary embodiment, the photoreceptor 30, the charging device 32, the latent image forming device 34, the transfer device 36, and the cleaning device 42 are enclosed in the housing 28 of the image forming structure 22. On the other hand, in this second exemplary embodiment, the photoreceptor 30, the charging device 32, the latent image forming device 34, and the cleaning device 42 are enclosed in the housing 28, but the transfer device 36 is not enclosed therein. In the second exemplary embodiment, transfer devices 36K, 36Y, 36M, 36C are installed in positions along the inside of the intermediate transfer belt 60 of the belt unit 26 instead of installing the transfer device 36 within the image forming structure 22.

The transfer devices 36K, 36Y, 36M, 36C are arranged substantially in a line in a substantially vertical direction. From the lowest position in the direction of gravitational force, the transfer device 36K, transfer device 36Y, transfer device 36M, and transfer device 36C are arranged in this order. The transfer devices 36K, 36Y, 36M, 36C are used to transfer a black developer image, a yellow developer image, a magenta developer image, and a cyan developer image to the intermediate transfer belt 60, respectively.

In the first exemplary embodiment, the development devices are installed such that, from the lowest position in the direction of gravitational force, the development device 24Y, development device 24M, development device 24C, and development device 24K are arranged in this order. On the other hand, in the second exemplary embodiment, the development devices are installed such that, from the lowest position in the direction of gravitational force, the development device 24K, development device 24Y, development device 24M, and development device 24C are arranged in this order. The initial position of the image forming structure 22 is a position where a latent image on the photoreceptor 30 is developed by the development device installed in the lowest position, as is the case for the first exemplary embodiment. Thus, a latent image carried by photoreceptor 30 set in the initial position is developed by the development device 24K using a black developer among the plural development devices 24Y, 24M, 24C, 24K.

Among the plural development devices 24Y, 24M, 24C, 24K, the development device 24K develops a latent image on the photoconductor body 30 in the position designed for the shortest distance among the distances from first transfer positions where developer images are transferred from the photo conductor drum 30 to the intermediate transfer belt 60 by the transfer devices 36K, 36Y, 36M, 36C, respectively, to a second transfer position where the developer images once transferred to the intermediate transfer belt 60 are transferred onto a sheet. That is, the distance L4 over which a black develop image is transported from the first transfer position to the second transfer position is shorter than the distances over which yellow, magenta, and cyan developer images are transported, respectively, from the first transfer positions to the second transfer position. Components corresponding to those mentioned in the first exemplary embodiment are assigned the same reference numbers in FIG. 7 and their explanation is not repeated.

Figure 8:
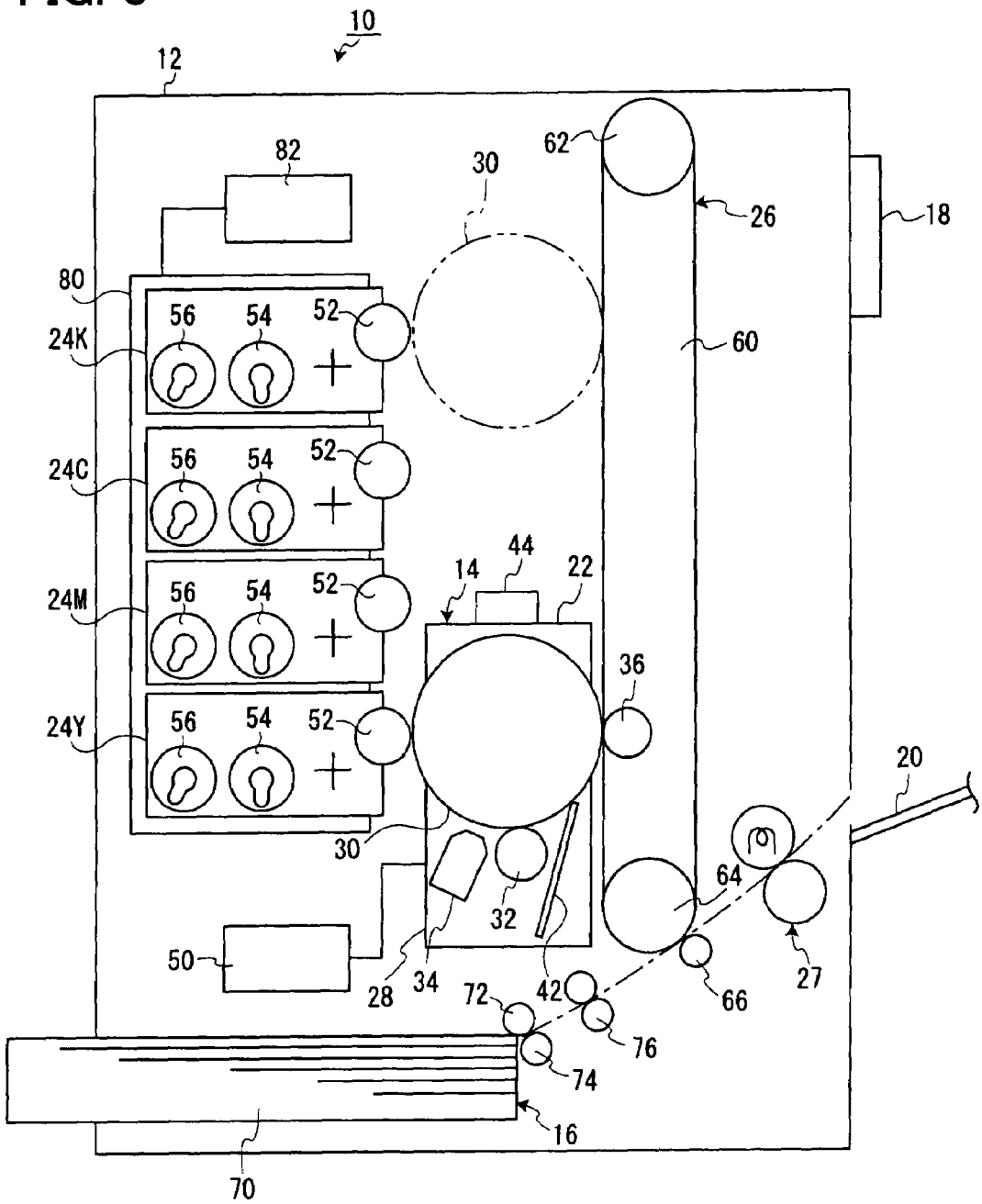
FIG. 8 is a front view showing a configuration of an image forming apparatus relevant to a third exemplary embodiment of the invention.

FIG. 8 shows an image forming apparatus 10 relevant to a third exemplary embodiment of the invention.

In comparison with the above-described first exemplary embodiment, a development device which is used to develop a latent image on the photoreceptor 30 is selected by, for example, vertically shifting the photoreceptor 30 installed in the image forming structure 22 in the first exemplary embodiment, whereas a development device which is used to develop a latent image on the photoreceptor 30 is selected by shifting both the photoreceptor 30 and the development devices 24Y, 24M, 24C, 24K in the third exemplary embodiment.

In the third exemplary embodiment, the development devices are arranged, as is the case for the first exemplary embodiment; i.e., from the lowest position of gravitational direction, the development devices 24Y, 24M, 24C, 24K are arranged in this order substantially in a line. The development devices 24K, 24Y, 24M, 24C are enclosed in one development device housing 80 and arranged such that at least a part of each of the development rollers 52 protrudes to contact with the photoreceptor 30.

A development device shifter 82 which is used as a second shifting mechanism unit is connected to the development device housing 80. The development device shifter 82 is equipped with a source of driving force, for example, a motor or the like (not shown) and shifts the development devices 24K, 24Y, 24M, 24C as an integral arrangement vertically inside the apparatus main body 12.

In the first exemplary embodiment, the photoreceptor 30 is shifted from one position to another among four positions: i.e., a position where a latent image carried by the photoreceptor 30 is developed by the development device 24Y, a position where it is developed by the development device 24M, a position where it is developed by the development device 24C, and a position where it is developed by the development device 24K. On the other hand, in the third exemplary embodiment, the photoreceptor 30 is shifted between a first position where the photoreceptor is depicted by a solid line (FIG. 8) and a second position where the photoreceptor is depicted by a two-dot chain line (FIG. 8). Components of the apparatus of the third exemplary embodiment corresponding to those mentioned in the first exemplary embodiment are assigned the same reference numbers and their explanation is not repeated.

FIGS. 9A to 9D illustrate the changing positions of the photoreceptor 30 shifted by the image forming structure shifter 50 and the changing positions of the development device housing 80 shifted by the development device shifter 82. As described above, the photoreceptor 30 is shifted between the first position depicted in FIGS. 9A and 9B and the second position depicted by FIGS. 9C and 9D. The development device housing 80 is shifted between a first position depicted in FIGS. 9A and 9C and a second position depicted in FIGS. 9B and 9D, wherein the second position is lower than the first position.

Figure 9D:
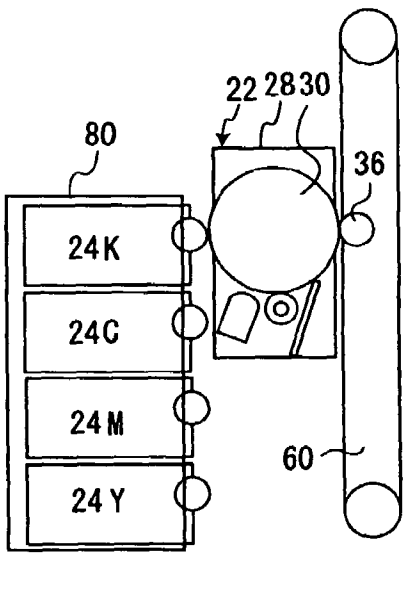
FIGS. 9A to 9D illustrate the changing positions of an image forming structure used in the image forming apparatus relevant to the third exemplary embodiment of the invention.
Figure 9C:
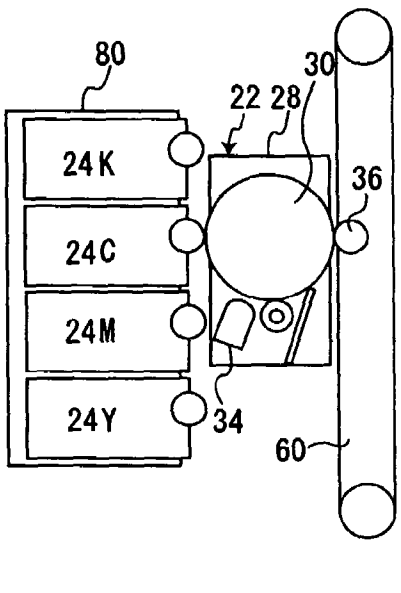
Figure 9B:
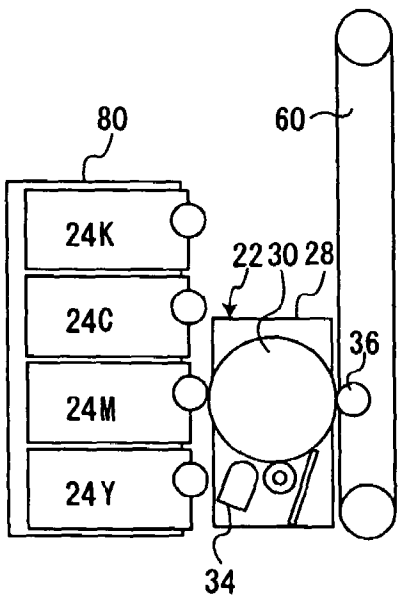
Figure 9A:
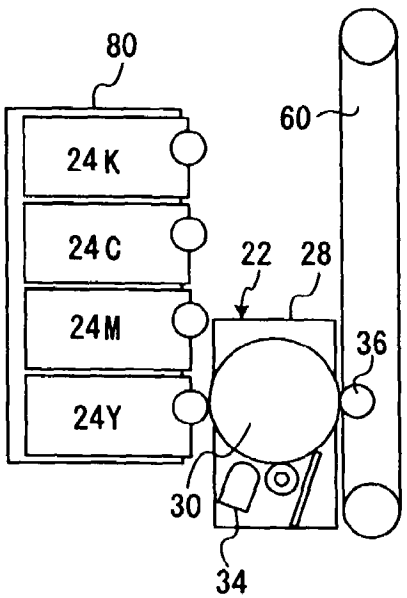

The photoreceptor 30 and the development device housing 80 start to be shifted from the initial position depicted in FIG. 9A and, usually, they are placed in the position depicted in FIG. 2A upon termination of a series of image forming operations or when the image forming apparatus 10 is powered on. When the photoreceptor 30 and the development device housing 80 are set in the initial position, a latent image carried by the photoreceptor 30 can be developed by the development device 24Y using a yellow developer. Thus, the position depicted in FIG. 9A is referred to as a yellow development position hereinafter.

In a position depicted in FIG. 9B, a latent image is developed by the development device 24M using a magenta developer and, therefore, the position depicted in FIG. 9B is referred to as a magenta development position hereinafter. In a position depicted in FIG. 9C, a latent image is developed by the development device 24C using a cyan developer and, therefore, the position depicted in FIG. 9C is referred to as a cyan development position hereinafter. In a position depicted in FIG. 9D, a latent image is developed by the development device 24K using a black developer and, therefore, the position depicted in FIG. 9D is referred to as a black development position hereinafter.

Figure 10:
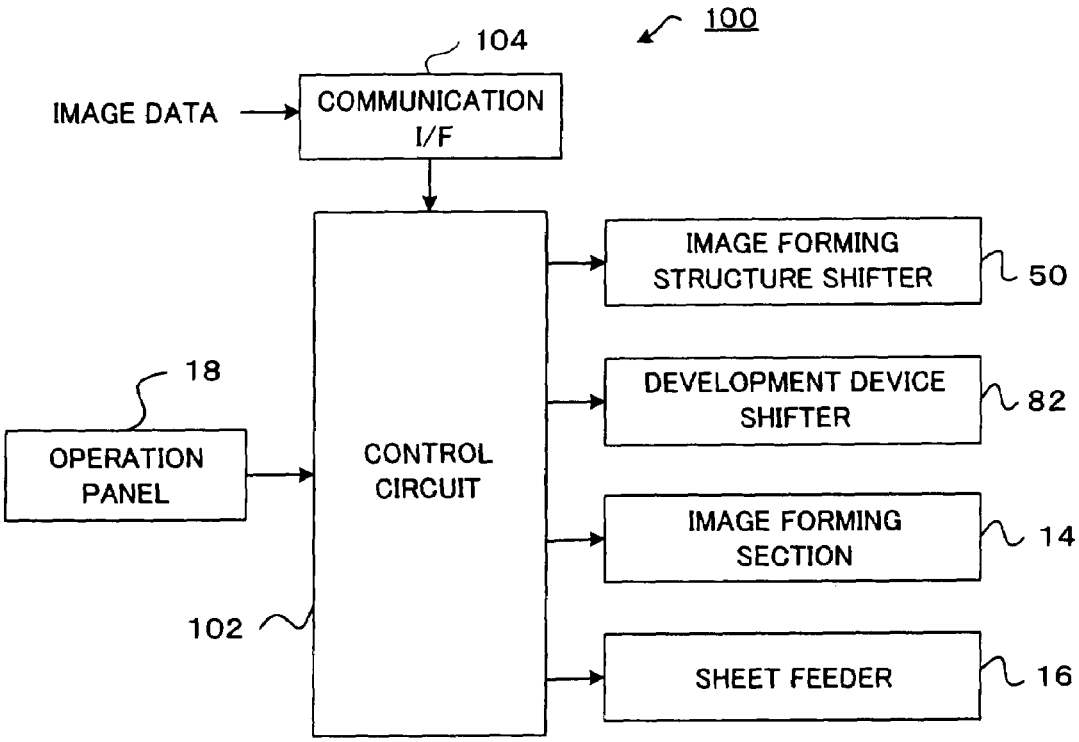
FIG. 10 is a block diagram showing a control device used in the image forming apparatus relevant to the third exemplary embodiment of the invention.

FIG. 10 shows a control device 100 built in the image forming apparatus 10 relevant to the third exemplary embodiment. In the above-described first exemplary embodiment, an output from the operation panel 18 is input to the control device 100 and the image forming section 14, sheet feeder 16, and image forming structure shifter 50 are controlled, according to an output from the control device 100. On the other hand, in the third exemplary embodiment, in addition to the image forming section 14, sheet feeder 16, and image forming structure shifter 50, the development device shifter 82 is also controlled, according to an output from the control device 100.

Figure 11:
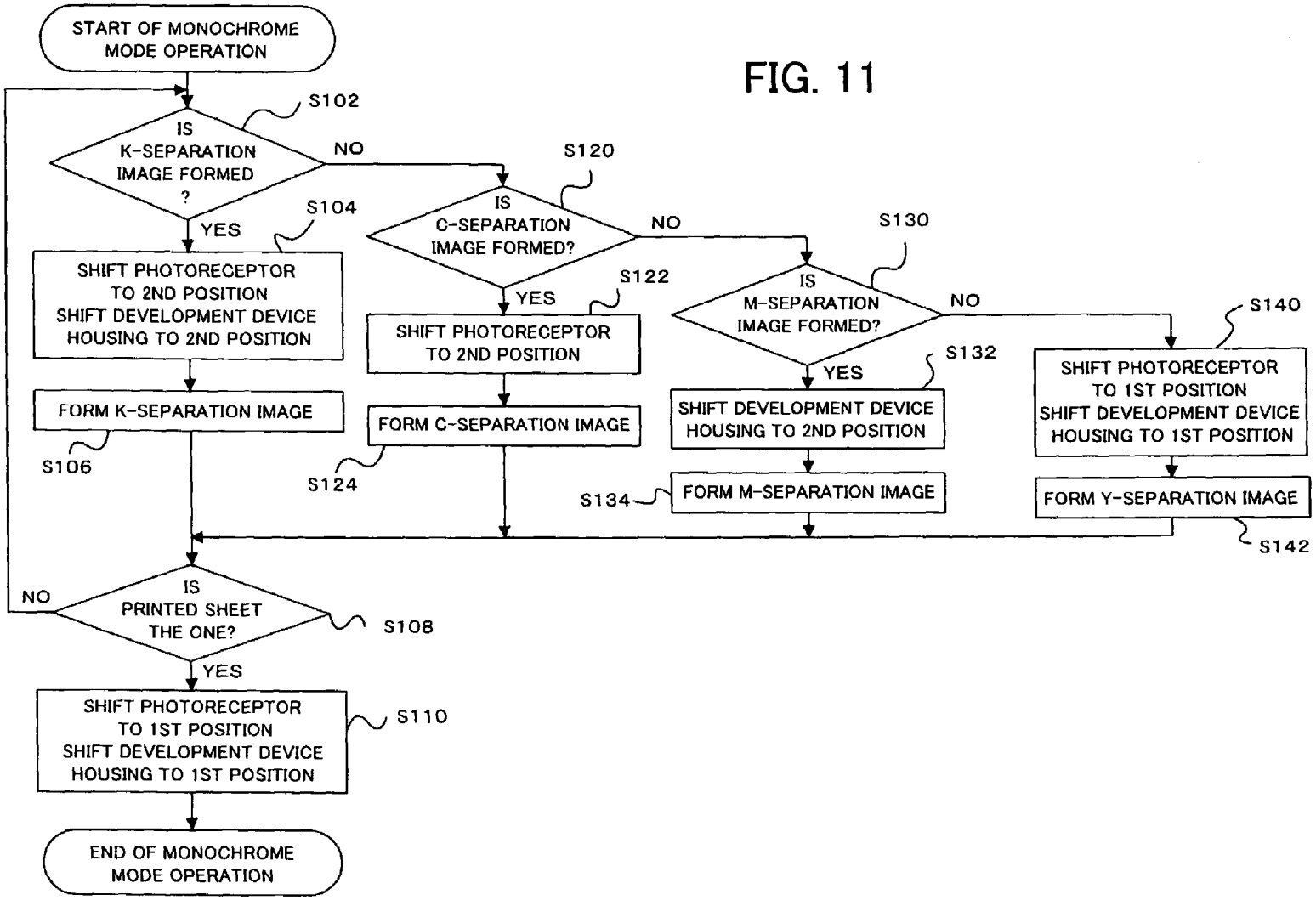
FIG. 11 is a first flowchart illustrating how the image forming apparatus operates, relevant to the third exemplary embodiment of the invention.
Figure 12:
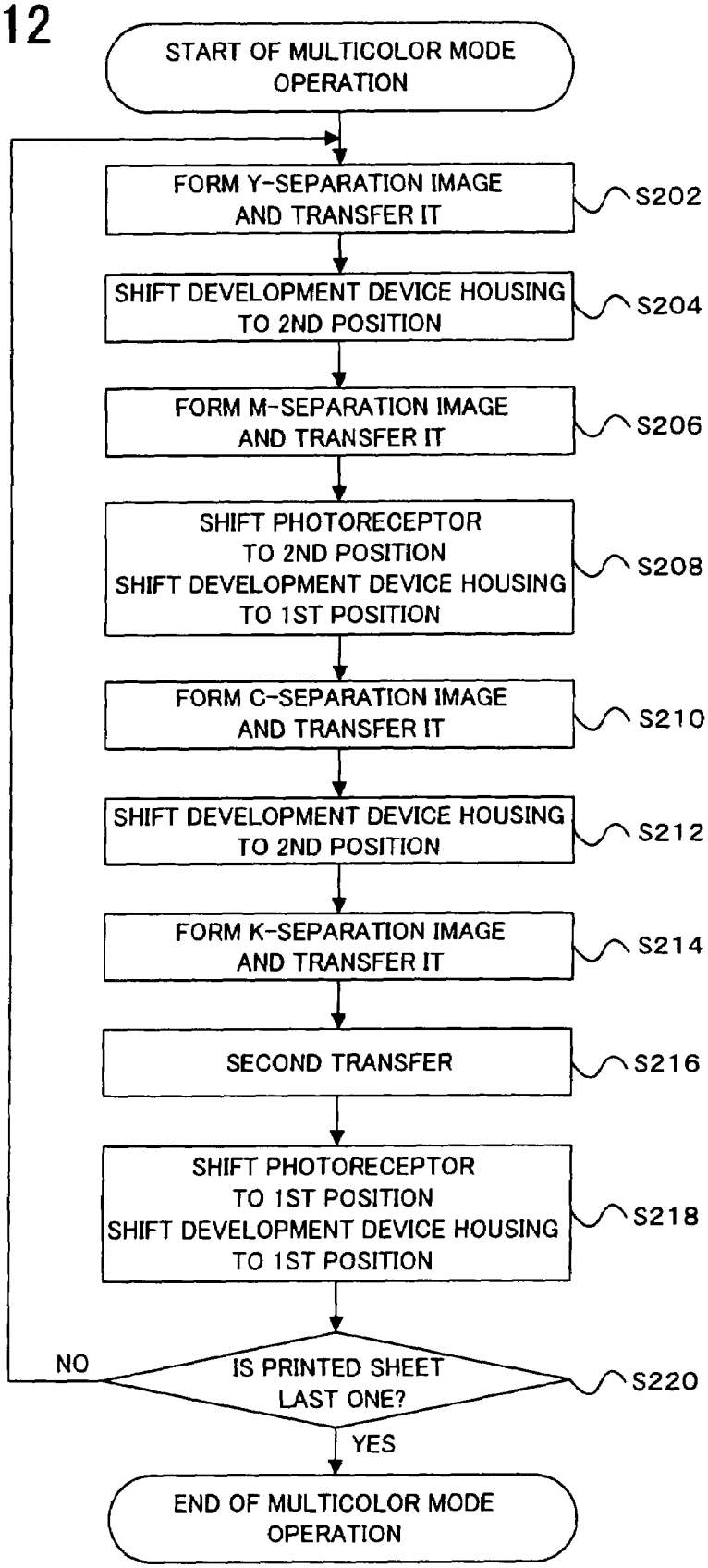
FIG. 12 is a second flowchart illustrating how the image forming apparatus operates, relevant to the third exemplary embodiment of the invention.

FIGS. 11 and 12 show flowcharts of control by the control device 100 used in the third exemplary embodiment. When an image forming operation starts, it is determined whether mode is a monochrome mode (see FIG. 4), based on an output from the operation panel 18, as is the case for the first exemplary embodiment. FIG. 11 shows a flowchart of a procedure in monochrome mode and FIG. 12 shows a flowchart of a procedure in multicolor mode.

As illustrated in FIG. 11, when a monochrome mode operation starts, the control device 100 determines whether a monochrome image to be formed is a black (K) separation image at step S102. If it is determined that the image to be formed is a black separation image, the procedure goes to a next step S104.

At step S104, the control device 100 controls the image forming structure shifter 50 and the development device shifter 82 to shift the photoreceptor 30 up to the second position and shift the development device housing 80 down to the second position, respectively, from the initial positions depicted in FIG. 9A. The image forming structure 22 and the development device housing 80 are set in the black development position depicted in FIG. 9A. The procedure goes to a next step S106.

At step 106, a black separation image is formed.

At a next step S108, it is determined whether the sheet on which the image has been formed is the last one. If it is determined that the sheet is the last one, the procedure goes to a next step S110. If it is determined that the sheet is not the last one, the procedure returns to step S102.

At step S110, the control device 100 controls the image forming structure shifter 50 and the development device shifter 82 to shift the photoreceptor 30 and the development device housing 80 to the yellow development position, i.e., the initial position depicted in FIG. 9A. Then, the image forming procedure in monochrome mode terminates.

If the image to be formed is not a black (K) separation image, as determined at the above step S102, the procedure goes to step S120. At step S120, it is determined whether a monochrome image to be formed is a cyan separation image. Then, if it is determined that the image to be formed is a cyan separation image, the procedure goes to a next step S122.

At step S122, the control device 100 controls the image forming structure shifter 50 to shift the photoreceptor 30 and the development device housing 80 up to the cyan development position depicted in FIG. 9C from the initial position depicted in FIG. 9A. The procedure goes to a next step S124.

At step S124, the control device 100 controls the image forming section 14 to form a cyan separation image. At this time, the development device 24C is used for development.

Next, it is determined whether the printed sheet is the last one at step S108, as in the case of forming a black separation image. If it is determined that the sheet is the last one, the control device 100 controls the image forming structure shifter 50 to shift the photoreceptor 30 down to the yellow development position depicted in FIG. 9A at step S110. Then, the image forming procedure in monochrome mode terminates.

If the printed sheet is not the last one, as determined at step S108, the procedure returns to step S102, as in the above-described case of forming a black separation image.

If the image to be formed is not a cyan separation image, as determined at the above step S120, the procedure goes to step S130. At step S130, it is determined whether a monochrome image to be formed is a magenta separation image. Then, if it is determined that the image to be formed is a magenta separation image, the procedure goes to a next step S132.

At step S132, the control device 100 controls the development device shifter 82 to shift the development device housing 80 down to the magenta development position depicted in FIG. 9B from the initial position depicted in FIG. 9A. The procedure goes to a next step S134.

At step 134, the control device 100 controls the image forming section 14 to form a magenta separation image. At this time, the development device 24M is used for development.

Next, it is determined whether the printed sheet is the last one at step S108, as in the case of forming a black separation image or a cyan separation image. If it is determined that the sheet is the last one, the control device 100 controls the development device shifter 82 to shift the development device housing 80 up to the yellow development position depicted in FIG. 9A at step S110. Then, the image forming procedure in monochrome mode terminates.

If the printed sheet is not the last one, as determined at step S108, the procedure returns to step S102, as in the above-described case of forming a black separation image or a cyan separation image.

If the image to be formed is not a magenta separation image, as determined at the above step S130, a monochrome image to be formed is not any of black, cyan, and magenta separation images and, therefore, the procedure goes to a next step S140 to form a yellow separation image.

At step S140, the control device 100 controls the image forming structure shifter 50 and the development device shifter 82, as appropriate, to shift the image forming structure 22 and the development device housing 80 to the yellow development position depicted in FIG. 9A.

At a next step S142, the control device 100 controls the image forming section 14 to form a yellow separation image. At this time, the development device 24Y is used for development.

At a next step S108, it is determined whether the printed sheet is the last one. If the sheet is not the last one, as determined at this step, the procedure returns to step S102. If the sheet is the last one, as determined at step S108, it is made certain that the photoreceptor 30 and the development device housing 80 are set in the first positions at step S110. Then, the image forming procedure in monochrome mode terminates.

FIG. 12 shows a flowchart of control by the control device 100 when an image is formed in multicolor mode in the third exemplary embodiment. When a multicolor mode operation starts, the control device 100 controls the image forming section 14 to form a yellow separation image at step S202. At this time, the development device 24Y is used for development. At step S202, a yellow developer image is formed on the surface of the photoreceptor 30 and this yellow developer image is transferred to the intermediate transfer belt 60.

At a next step S204, the control device 100 controls the development device shifter 82 to shift the image forming structure 22 and the development device housing 80 down to the second position depicted in FIG. 9B.

At a next step S206, a magenta developer image is formed on the photoreceptor 30 and this magenta developer image is transferred to the intermediate transfer belt 60 in a fashion to be overlaid on top of the yellow developer image. In the operation of step S206, the development device 24M is used for development.

At a next step S208, the control device 100 controls the image forming structure shifter 50 and the development device shifter 82 to shift both the photoreceptor 30 and the development device housing 80 up, so that the photoreceptor 30 is shifted to the second position and the development device is shifted to the first position.

At a next step S210, a cyan developer image is formed on the photoreceptor 30 and this cyan developer image is transferred to the intermediate transfer belt 60 in a fashion to be overlaid on top of the yellow and magenta developer images. In the operation of step S210, the development device 24C is used for development.

At a next step S212, the control device 100 controls the development device shifter 82 to shift the development device housing 80 down, so that the development device housing 80 is shifted down to the second position.

At a next step S214, a black developer image is formed on the photoreceptor 30 and this black developer image is transferred to the intermediate transfer belt 60 in a fashion to be overlaid on top of the yellow, magenta, and cyan developer images. In the operation of step S214, the development device 24K is used for development.

At a next step S216, the control device 100 controls the sheet feeder 16 so that a multicolor developer image in which the yellow, magenta, cyan, and black developer images are combined, carried on the intermediate transfer belt 60, is transferred to a sheet by the second transfer roller 66. The multicolor developer image transferred to the sheet is fixed to the sheet by the fixing device 27.

At a next step S218, the control device 100 controls the image forming structure shifter 50 to shift the photoreceptor 30 down, so that the photoreceptor 30 is shifted to the first position, and controls the development device shifter 82 to shift the development device housing 80 up, so that the development device housing is shifted to the first position. In other words, the photoreceptor 30 and the development device housing 80 are shifted to the initial positions.

At a next step S220, it is determined whether the sheet on which the image has been formed is the last one. If the sheet is the last one, the multicolor mode terminates and the image forming procedure terminates. If the sheet on which the image has been formed is not the last one, as determined at step S220, the procedure returns to step S202.

In the above-described control flow of the image forming apparatus 10 relevant to the third exemplary embodiment, when shifting the image forming structure 22 in the steps of doing so, control may be performed such that the photoreceptor 30 is run by the driving device 44 during the shift motion of the image forming structure 22 by control of the control circuit 102. If the photoreceptor 30 is run during the shift motion of the image forming structure 22, latency before the start of forming an image by the shifted image forming structure 22 becomes shorter than when the transfer of the driving force to the photoreceptor 30 is started after the shift of the image forming structure 22.

Figure 13:
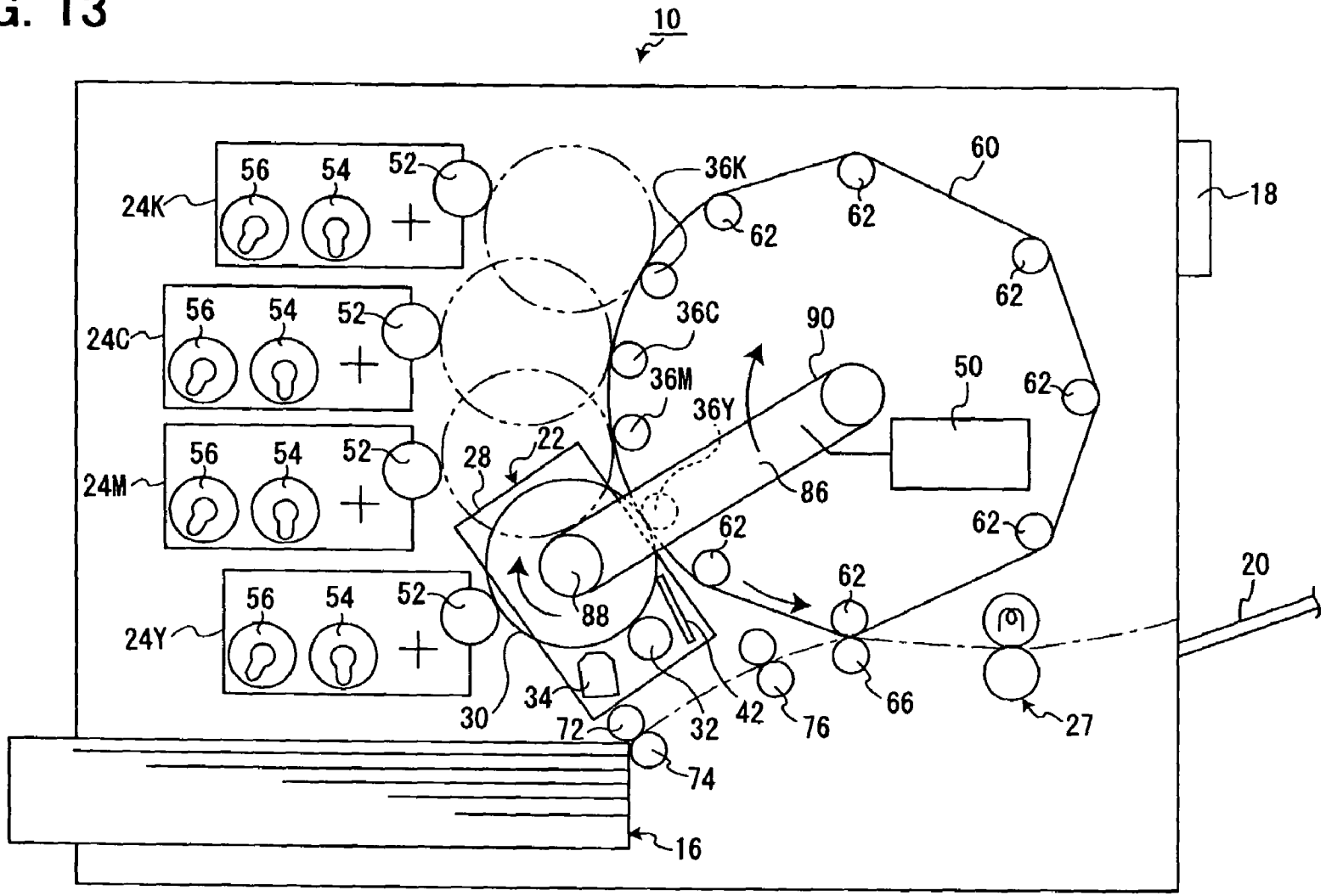
FIG. 13 is a front view showing a configuration of an image forming apparatus relevant to a fourth exemplary embodiment of the invention.

FIG. 13 shows an image forming apparatus 10 relevant to a fourth exemplary embodiment of the invention.

In the above-described first exemplary embodiment, the image forming structure 22 is shifted along a path that is substantially linear in a substantially vertical direction. On the other hand, in the fourth exemplary embodiment, the image forming structure 22 is shifted along a curved path that forms an arc substantially.

In the fourth exemplary embodiment, one end of a support member 86 that supports the image forming structure 22 is rotatably connected to the housing 28 of the image forming structure 22 via a shaft 88. The other end of the support member 86 is connected to the apparatus main body via a shaft 90 so that the support member is rotatable with respect to the apparatus main body 12.

An image forming structure shifter 50 is connected to the support member 86 so that the support member 86 can be turned on the shaft 90 by the driving force transferred to it from the image forming structure shifter 50. Therefore, by controlling the image forming structure shifter 50, the photo receptor 30 can be shifted in conjunction with the support member 86 and the housing 28. The photoreceptor 30 can be shifted from one position to another among a position where the photoreceptor is depicted by a slid line and three positions where the photoreceptor is depicted by a two-dot chain line in FIG. 13. In each position, a latent image carried by the photoreceptor is developed by any of the development devices 24Y, 24M, 24C, 24K.

In the fourth exemplary embodiment, the intermediate transfer belt 60 is suspended in a tensioned state on transfer devices 36Y, 36M, 36C, 36K each of which is formed of, for example, a roller and, for example, seven support rollers 62 in such a fashion as to, for example, form a circle substantially. At least one of the seven support rollers 62 serves as a driving roller which transfers driving force to the intermediate transfer belt 60 and the remaining support rollers 62 serve as driven rollers which are driven by the motion of the intermediate transfer belt 60. Components of the apparatus of the fourth exemplary embodiment corresponding to those mentioned in the above-described first exemplary embodiment are assigned the same reference numbers in FIG. 13 and their explanation is not repeated.

The present invention as described above can be applied to, for example, image forming equipment such as copiers, facsimile machines, and printers including an image carrier such as a photoreceptor and development devices that develop a latent image carried by the image carrier.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An image forming apparatus comprising:

an image forming structure including an image carrier that carries an image and an optical writing device that writes a latent image onto the image carrier in an integral arrangement;

a plurality of development devices that develop a latent image carried by the image carrier;

a shifting mechanism unit that shifts the image forming structure relative to the development devices; and a shift controller that controls the shifting mechanism unit so that the image carrier is shifted to a development position in contact with one of the development devices in a predetermined order.

2. The image forming apparatus according to claim 1, further comprising:

a driving device that drives the image carrier, provided in an integral arrangement with the image carrier within the image forming structure; and a driving device controller that controls the driving device to drive the image carrier during the shift motion of the image forming structure.

3. The image forming apparatus according to claim 1, wherein one of the development devices is for black and an initial position of the image forming structure is a development position in which the image carrier is set to come in contact with the development device for black.

4. The image forming apparatus according to claim 1, further comprising a charging device that charges the image carrier, wherein the image forming structure includes the charging device in an integral arrangement with the image carrier.

5. The image forming apparatus according to claim 1, further comprising a cleaning device that cleans the image carrier, wherein the image forming structure includes the cleaning device in an integral arrangement with the image carrier.

6. The image forming apparatus according to claim 1, wherein a length of the image forming structure in the structure's shift direction is narrower than an entire length of the plurality of development devices in the image forming structure's shift direction.

7. The image forming apparatus according to claim 1, wherein the shifting mechanism unit shifts the image forming structure approximately in a straight line.

8. The image forming apparatus according to claim 1, wherein the shifting mechanism unit shifts the image forming structure approximately along an arc.

9. An image forming apparatus comprising:

an image forming apparatus main body;

an image forming structure including an image carrier that carries an image and an optical writing device that writes a latent image onto the image carrier in an integral arrangement, provided within the apparatus main body;

a plurality of development devices that develop a latent image carried by the image carrier, which are fixed relative to the apparatus main body;

a shifting mechanism unit that shifts the image forming structure relative to the development devices; and a shift controller that controls the shifting mechanism unit so that the image carrier is shifted to any development position in contact with one of the development devices in a predetermined order.

10. The image forming apparatus according to any of claim 9, wherein a length of the image forming structure in the structure's shift direction is narrower than an entire length of the plurality of development devices in the image forming structure's shift direction.

11. The image forming apparatus according to claim 9, wherein the shifting mechanism unit shifts the image forming structure approximately in a straight line.

12. The image forming apparatus according to claim 9, wherein the shifting mechanism unit shifts the image forming structure approximately along an arc.

13. An image forming apparatus comprising:

an image forming apparatus main body;

an image forming structure including an image carrier that carries an image and an optical writing device that writes a latent image onto the image carrier in an integral arrangement, provided within the apparatus main body;

a plurality of development devices that develop a latent image carried by the image carrier, which are provided within the apparatus main body;

a first shifting mechanism unit that shifts the image forming structure relative to the apparatus main body;

a second shifting mechanism unit that shifts the development devices relative to the apparatus main body; and a shift controller that controls the first and second shifting mechanism units so that the image carrier is shifted to any development position in contact with one of the development devices in a predetermined order.

* * * * *